United States Patent [19]

Cobb

[11] Patent Number: 4,653,209

[45] Date of Patent: Mar. 31, 1987

[54] DIRECTORY SIGN MASK

[75] Inventor: Ronald W. Cobb, Covington, Ga.

[73] Assignee: Apco Graphics, Inc., Atlanta, Ga.

[21] Appl. No.: 664,593

[22] Filed: Oct. 25, 1984

[51] Int. Cl.[4] ..... G09F 7/02

[52] U.S. Cl. ..... 40/618; 40/10 R; 40/568; 40/159

[58] Field of Search ..... 40/10 R, 618, 568

[56] References Cited

U.S. PATENT DOCUMENTS

| | | | |
|---|---|---|---|
| 2,687,590 | 8/1954 | Johnson | 40/159 |
| 2,775,050 | 12/1956 | Ellsqorth | 40/159 |
| 3,660,918 | 5/1972 | Bourseau . | |
| 3,707,792 | 1/1973 | Mabrey et al. . | |
| 3,905,139 | 9/1975 | Cooper | 40/586 |

*Primary Examiner*—Gene Mancene
*Assistant Examiner*—Wenceslao J. Contreras
*Attorney, Agent, or Firm*—Jones & Askew

[57] ABSTRACT

A mask and mask assembly for use in a directory sign or the like. One or more masks are affixed to a backing panel, thereby defining a number of adjacent parallel channels for removably receiving message strips in the form of transparencies or the like. The mask comprises a substantially plane sheet member preferably flat on the front side, and on the back side having a number of raised lands longitudinally extending along the mask. The lands are laterally spaced apart from each other, and this facing defines the channels for receiving message strips. The masks have complementary overlapping lateral edges, so that a number of masks can be aligned side-to-side on a backing panel.

13 Claims, 5 Drawing Figures

DIRECTORY SIGN MASK

FIELD OF INVENTION

This invention relates in general to signage, and relates in particular to directory signs or the like.

BACKGROUND OF THE INVENTION

Directory signs are used to display the names and office locations of persons, departments or the like in buildings or other locales. Because the occupants of most office or institutional buildings will change over time, the directory sign should easily accommodate corresponding changes in the names displayed by that sign. Furthermore, the directory sign should easily accommodate adding or removing names in an established sequence of names, without leaving unsightly gaps or blank spaces in the directory.

Directory signs of the prior art have utilized various expedients in an attempt to meet these and other desired goals. For example, directory signs are known which have each individual person's name and office location on an elongated strip of transparent or opaque material. These strips are first arranged in the desired alphabetical or other order, and the individual strips next are clamped in place within a frame which maintains the overall message strip array. In order to add or delete a name, the entire array of strips must be disassembled, the appropriate strips inserted or removed, and the array then reassembled in the desired order, a chore which is particularly troublesome because of the vertical orientation of most directory signs. This trouble is exacerbated in signs where the individual names are displayed on glass strips, because of the risk of breakage and physical injury resulting when the combined glass strips are disassembled.

Another kind of prior-art directory sign utilizes separate message compartments to receive and display message inserts, and an example is shown in U.S. Pat. No. 3,660,918. These compartments or insert holders typically comprise a plurality of individual channel members which are assembled in a frame to form the directory sign. The individual message strips are pinned or otherwise located in the appropriate insert. Name changes in such directory signs are made by removing the particular insert and changing the message therein, and then replacing the insert in the array of inserts making up the directory sign. New names may be added by moving the existing inserts upwardly as a unit, making room to install a new insert containing the name being added. However, this arrangement also is relatively awkward, and directory signs constructed of such individual removable message holders tend to be relatively expensive.

SUMMARY OF THE INVENTION

Stated in general terms, the present invention comprises an improved directory sign mask for receiving and supporting a plural number of directory message strips, and an improved directory sign incorporating this mask. The directory sign mask is intended and designed for permanent securement to a backing panel, so that several separate message-receiving channels are defined between a single mask and the backing panel. A number of such masks can be arrayed in juxtaposition with each other along a single backing panel, thereby multiplying the number of individual message-receiving channels available in the resulting directory sign.

Stated somewhat more particularly, the present directory masks comprise a substantially plane sheet member having on the back side a plurality of protrusions extending along the length of the sheet member. These protrusions are laterally spaced from each other by a distance which defines the width of the channels for receiving the individual message strips. When one or more such masks is affixed to a backing panel, the protrusions contact the backing panel and maintain the plane sheet member spaced outwardly from the backing panel a sufficient distance to define the depth of each message strip channel. The backing panel and at least one such mask thus form a unitary composite structure which defines a plurality of channels between the mask and the backing panel, for receiving a corresponding plurality of message strips.

Separate windows are formed in the sheet member at the regions between the raised protrusions, so as to expose the message strips to view from the other or front side of the sheet member. The backing panel may be translucent or transparent, and preferably is back-lit to cast illumination through the indicia on the changeable message strips. The lateral edges of the message strips preferably are provided with complementary overlapping flanges, enabling the flanges of adjacent message strips to overlap each other in such a way as to block any unwanted light from passign between the message strips. In this way, an attractive finished overall directory sign utilizing a plurality of the present masks can be provided without requiring precise alignment between adjacent masks.

Stated with somewhat further detail, the raised protrusions on the back of the mask preferably comprise elongated lands extending substantially the length of the mask. These lands provide substantially the only physical contact between the mask and the backing panel, so that the masks can be fused or otherwise bonded to the backing panel at the areas of contact of the lands. Each land preferably contains an elongated groove positioned to face the backing panel, to enhance the attachment between the panel and the mask.

Accordingly, it is an object of the present invention to provide an improved directory sign.

It is another object of the present invention to provide an improved mask for use with directory signs or the like.

It is a further object of the present invention to provide a directory sign mask intended for permanent affixation to a backing panel of the directory sign.

It is yet another object of the present invention to provide a lightweight directory sign mask which becomes permanently affixed to other portions of the directory sign, and which can removably receive a number of individual message strips.

Other objects and advantages of the present invention will become more readily apparent from the following description of a preferred embodiment.

DESCRIPTION OF PREFERRED EMBODIMENT

Figure 1:
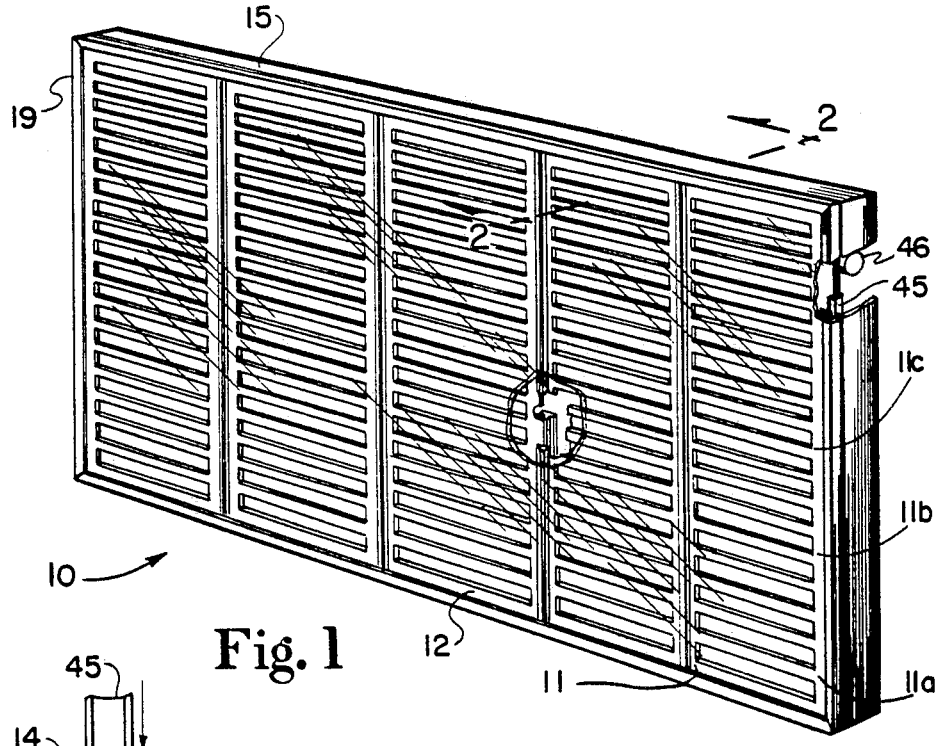
FIG. 1 is a pictorial view showing a directory sign according to a preferred embodiment of the present invention.

Turning first to FIG. 1, there is shown generally at 10 an example of a directory sign utilizing a plurality of directory sign masks 11 according to the present invention. The directory sign 10 is configured with five adjacent vertical message-display panels, one such panel being denoted at 12, but it will be understood that the overall size of the sign is determined by the anticipated number of names or locations to be displayed thereon, and is not a critical limitation imposed by the present invention. Adjacent message display panels in the sign 10 may be retained and supported by interposed T-extrusions or by other suitable techniques. The directory sign 10 includes a suitable housing including the external frame members 15 surrounding the sign.

Figure 2:
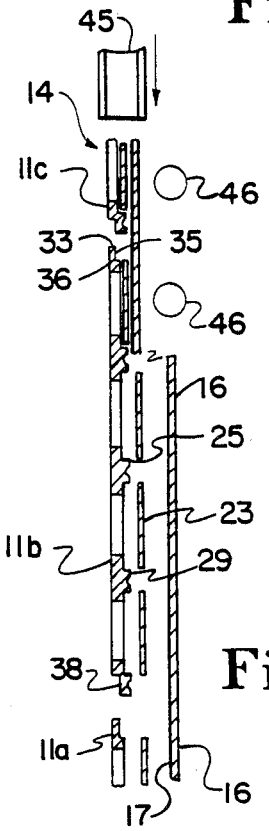
FIG. 2 is a partially-exploded fragmentary section view taken along line 2—2 of FIG. 1.
Figure 3:
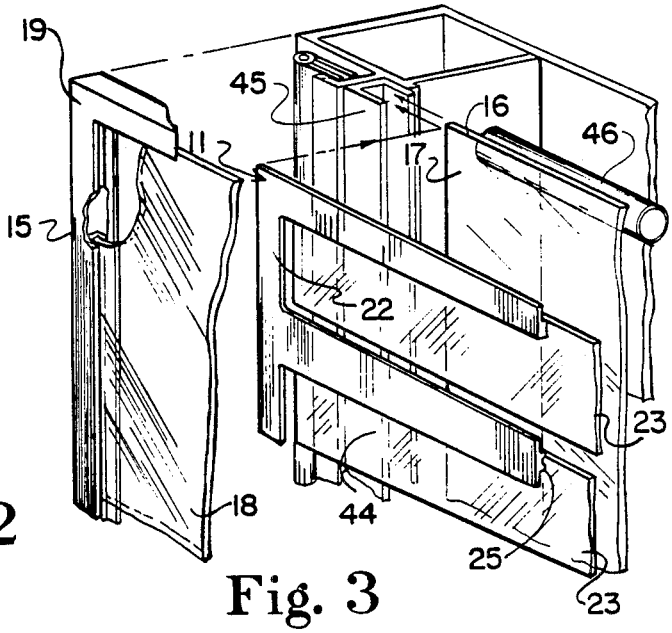
FIG. 3 is an exploded pictorial view showing a corner portion of the directory sign in FIG. 1.
Figure 4A:
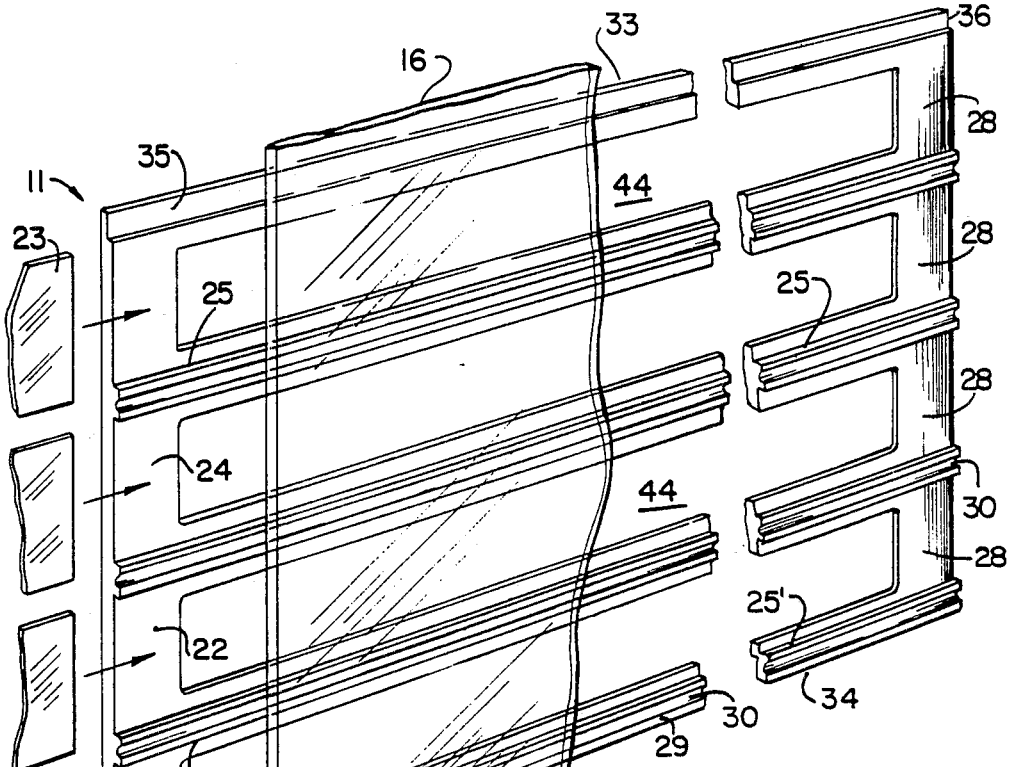
FIG. 4 is a broken pictorial view showing a directory sign mask as in the disclosed embodiment, from the back side thereof.
FIG. 4B is a fragmentary exploded pictorial view illustrating the overlapping relation between two contiguous masks according to the disclosed embodiment.

Each message display panel 12 in the directory sign 10 preferably is made up of several individual directory sign masks 11*a*, 11*b*, 11*c*, . . . stacked in contiguous adjacent array. These masks are identical to each other, and the details of an exemplary mask 11*b* are best seen in FIGS. 2, 3, and 4A. In considering the following explanation, it should be understood that the directory sign masks 11 in the disclosed embodiment are permanently affixed to the front surface 17 of a backing panel 16 contained within the frame 15 of the directory sign 10. A separate transparent cover panel 18 is mounted on the door 19 which is attached to the frame 15 by a suitable hinge at one side of the frame. The cover panel 18, which is in front of the arrayed masks 11 but is not affixed to the masks 11, protects the masks and the directory message strips from dirt or tampering from outside the sign 10. The cover panel 18 preferably is a low light transmission safety glass having a gray or similar dark tint, so that the directory sign appears as a single black monolithic element with illuminated indicia or graphics.

Each mask 11 in the disclosed embodiment includes a substantially plane sheet body 22 having a longitudinal dimension slightly longer than the length of the message strips 23 held by the mask, and having a lateral dimension slightly greater than some whole-number multiple of the width of these message strips. The front surface 39 (FIG. 4B) and back surface 24 of the mask body 22 preferably are plane parallel surfaces. Protruding outwardly from the back surface 24 of each mask 11 are a number of laterally spaced-apart lands 25, running parallel with the longitudinal dimension of the mask. The adjacent lands 25 are laterally spaced apart from each other by an amount slightly greater than the width of the message strips 23, and the lateral space between adjacent pairs of lands thus defines corresponding channels 28 (FIGS. 4A and 4B) for slidably receiving individual message strips 23. Each land 25 is formed with a flattened back surface 29, FIG. 2, and these back surfaces of the lands on a particular mask 11 preferably occupy a common plane parallel to the body 22 of the mask. A longitudinal groove 30 (FIG. 4A) preferably is formed in the back surface 29 of each land 25, for a purpose described below.

The lateral edges 33 and 34 of each mask 11 are formed to provide complementary mutually overlapping flanges. The flange associated with the first lateral edge 33 is provided by an undercut region 35 formed in the back surface 24 of the mask body 22. This undercut region 35 extends along the entire length of the mask 11, and defines the first flange 36 in the back side of the mask. This flange 36 does not protrude from the front face 39 of the mask, best seen in FIGS. 2, 3, and 4B.

The second flange 37, at the opposite edge 34 of the mask 11, is formed by another undercut region 38 extending the length of the mask body 22. The undercut region 38, unlike the first such region 35, is formed inwardly from the front surface of the mask body. This second undercut region 38 coincides in lateral location with the lowermost land 25' formed on the back surface of the mask 11. The depth of the undercut region 38, measured inwardly from the front surface 39 of the mask 11, should be substantially equal to the thickness of the first flange 36 formed at the opposite lateral edge 33 of the mask.

Each mask 11 includes a number of elongated windows 44 formed in the body 22 of the mask, between adjacent pairs of lands 25. These windows 44 preferably are somewhat smaller in length and width than the corresponding dimensions of the message strips 23 to be received behind the windows, and it is apparent that each window 44 is centrally aligned with a corresponding channel 28 in the mask 11. Although the mask 11 depicted herein has four windows 44 and a corresponding number of channels 28, a greater or lesser number of windows and corresponding message strip channels 28 can be provided in each mask. Masks according to the present invention normally would have a multiple number of such windows and message strip channels, for efficiently building a directory sign as described below. Each individual mask is preferably formed by molding from a suitable plastic material, so that each mask as described is a unitary article.

Figure 4B:
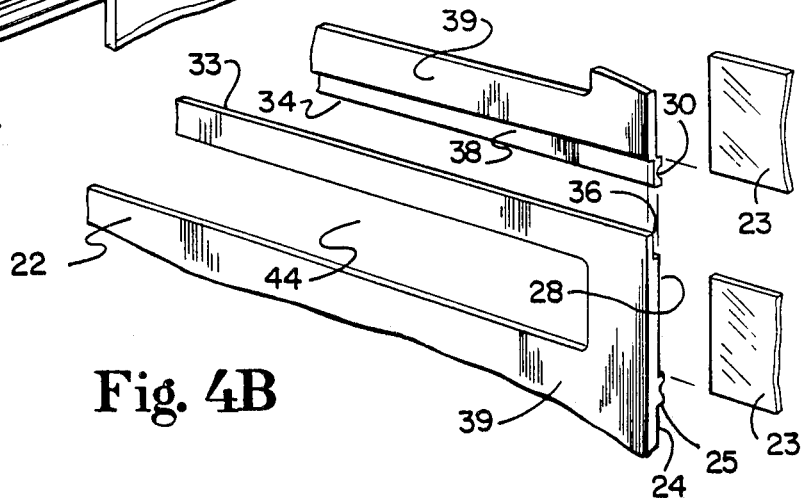

To build a message-display panel 12 according to the present invention, the number of masks 11*a*, 11*b*, . . . necessary to provide a vertical panel 12 having the desired number of windows 44 are arrayed in adjacent contiguous relation as best seen in FIGS. 2 and 4B. It should be understood that each such mask in the vertical panel 12 need not have the same number of windows. Adjacent masks 11 are aligned so that front undercut region 38 of the second flange 37 at the lower lateral edge 34 of a mask is overlapped by the flange 36 at the upper lateral edge 33 of the adjacent mask. The aligned masks 11 are affixed to the front surface 17 of the backing panel 16 by chemical fusing, although any other suitable securement technique such as adhesive bonding may be used. The grooves 30 extending along the back surfaces 29 of the lands 25 allow the introduction of chemical bonding agent by capillar action along the length of the loads, facilitating the fusing interaction between the lands and the backing panel. This fusing produces the desired assembly of masks and backing panel into a unitary composite mask assembly 14 for mounting in the frame of the directory sign 10; the unexploded portion of FIG. 2 depicts a slight separation of mask and backing panel for illustration purposes.

The directory sign is internally illuminated, and a pair of exemplary light sources such as fluorescent tubes 46 are shown in FIG. 2. The backing panel 16 must be at least partially light-transmissive and preferably is a translucent white acrylic material to diffuse the illumination from the tubes 46. The masks 11 preferably are opaque, so that illumination from the lamp tubes 46 can shine only through the windows 44 formed in the masks. A single backing panel 16 preferably receives and supports all the masks 11 of a particular message display panel 12, so that all the windows 44 of that message display panel receive even illumination notwithstanding possible ageing of the backing panel.

Once the mask assembly 14 is prepared as described above, message strips 23 can be inserted in the individual channels 28 defined between the back surface 24 of the mask and the front surface 17 of the backing panel 16. Each message strip 23 contains a desired message, such as the name and office number of a person being listed on the directory sign 10. The message strips 23 are dimensioned to be readily slidable into the ends of the channels 28, when the mask assembly 14 is temporarily removed from the directory sign frame 15. The message strips 23 thus can be changed or rearranged at will, without in any way disturbing the construction of the mask assembly 14. One or more mask assemblies 14, with message strips in place, comprises a cartridge which is peripherally surrounded by the removable rubber U-gasket 45 and installed within the frame 15. The gasket eliminates light leaks around the edge of the cartridge, and secures the message strips within the channels 28.

Those skilled in the art will recognize that the message strips 23 can be provided by any conventional techniques. One such technique uses negative film strips, in which the name or other directory information appears transparent on an otherwise-opaque film strip. The back-lighting in the directory sign 10 illuminates only the message indicia, providing an aesthetically pleasing appearance of illuminated names contrasting with the dark background formed by the front surface of the aligned masks 11. The overlapping flanges 36 and 37 between adjacent masks provides a light-tight joint between adjacent masks, preventing unsightly lines of illumination from being visible in the directory. The use of the overlapping flange joint permits this light-tight interconnection without requiring precision formation or alignment of confronting lateral edge surfaces on the masks.

As pointed out previously, names or other information contained on the present directory sign are easily changed by rearranging the message strips 23 in the corresponding channels 28. The message strips 23 are relatively lightweight and easily handled without risk of breakage, and several adjacent strips may readily be removed and laterally displaced to new channels as necessary to make room for adding a new message strip in proper alphabetical or numerical sequence. A name-bearing message strip 23 also can be removed and replaced with an opaque message strip if necessary, without leaving an unsightly illuminated gap in the sign 10.

It should also be apparent that the foregoing relates only to a preferred embodiment of the present invention, and that numerous modifications and changes therein may be made without departing from the spirit or scope of the invention as defined in the following claims.

I claim:

1. A mask for positioning a columnar array of name strips in a directory sign, said mask comprising:

a substantially plane opaque sheet member having a length at least substantially as long as the length of a message strip, and having a width at least equal to the width of a multiple number of such message strips;

a plurality of raised lands extending along the length of said sheet member in mutually spaced apart relation on one side thereof;

the distance between adjacent pairs of lands being sufficient to receive the width of a message strip with a sliding fit; and separate transparent windows formed in said opaque sheet member at the regions between said lands, so as to expose the messages of the message strips to view from the other side of the sheet member.

2. The mask as in claim 1, wherein said lands include a land surface spaced a predetermined distance behind said one side of the sheet member for contacting a backing panel on which the sheet member is to be mounted; and grooves are formed in said land surfaces to receive and disseminate an amount of a bonding agent as the land surfaces are bonded to the backing panel, whereby the bonding agent in the grooves aids in securing said lands of the sheet member to the backing panel.

3. The mask as in claim 1, wherein:

the lateral extremities of said sheet member comprise mutually complementary overlapping flanges so that a plurality of said masks can be contiguously adjoined with the complementary flanges of adjacent masks overlapping to form a smooth surface along the other sides of the plural sheet members.

4. The mask as in claim 3, wherein:

said lands each include a land surface in a plane spaced a predetermined distance in back of said one side of said sheet member, for contacting a backing panel on which the sheet member is to be mounted;

one of said lands and land surfaces being formed on only one of said complementary flanges; and said land surfaces are grooved to receive and disseminate an amount of a bonding agent as the land surfaces are bonded to the backing panel, whereby the bonding agent in the grooves helps secure said sheet member to the backing panel.

5. Message sign apparatus comprising:

a backing panel having front and back sides;

at least one mask affixed to the front side of said backing panel and defining recesses for receiving a plurality of message strips;

said mask comprising a plane member having a back surface confronting and substantially coplanar with the front side of said backing panel; said mask having a plurality of raised lands extending a certain distance back from the back surface of said plane member and affixed to the front side of said backing panel;

said lands extending longitudinally in a first direction, and being mutually spaced apart to define a plurality of channels into which message strips can be slidably disposed, and window means formed in said plane member between said lands so that the message strips in said channels can be viewed from the front of said mask.

6. Apparatus as in claim 5, wherein:

said lands each have a surface for contacting the front side of said backing panel and supporting the mask plane member away from said backing panel to define said channels; and groove means formed in said land surfaces to receive and retain a bonding agent to affix the mask to the backing panel.

7. Apparatus as in claim 6, wherein:

said backing panel is at least partially transparent to illumination, and said mask is opaque; and further comprising means located at the back side of the backing panel to illuminate the backing panel and thus to illuminate the message strips disposed in said channels;

whereby the opaque mask blocks all said illumination except for the illumination permitted by the message strips to pass through said windows.

8. Apparatus as in claim 5, further comprising:

a plurality of said masks continguously affixed to the front side of said backing panel;

said masks each having lateral sides parallel with said windows; and said lateral sides comprising mutually overlapping complementary flanges which adjoin and overlap the flanges of the contiguous said masks affixed to said backing panel, so that the plural masks are adjoined on the backing panel with no gaps between adjacent panels.

9. Apparatus as in claim 8, wherein:

said flange on one side of each said mask comprises a first region undercut from the back surface of the mask and extending along the back of said one side;

said complementary flange on the other side of the mask comprises a second region undercut from the front of the mask and extending along said other side; and said first and second undercut regions mutually overlap each other on adjoining contiguous masks affixed to said backing panel, thereby blocking the passage of illumination between two contiguous masks.

10. Apparatus as in claim 9, wherein:

one of said lands is located on the back surface in substantial alignment with said second region undercut from the front surface, so as to contact the backing panel in juxtaposition with the complementary overlapping joinder between' contiguous said masks on the backing panel.

11. Message sign apparatus comprising:

a backing panel having front and back sides;

a plurality of masks affixed to the front side of said backing panel and defining recesses for receiving a plurality of message strips;

said masks comprising a plane members each having a back surface confronting and substantially coplanar with the front side of said backing panel;

said masks having a plurality of raised lands extending a certain distance back from the back surface of said plane member and affixed to the front side of said backing panel so that the back surfaces of the masks are maintained spaced a certain distance from the front side of the panel;

said lands extending longitudinally in a first direction and being mutually spaced apart to define a plurality of channels between the lands, into which message strips can be slidably disposed, and window means formed in said plane member between said lands so that the message strips in said channels can be viewed from the front of said mask.

12. Apparatus as in claim 11, wherein:

said masks are substantially opaque, except for said window means;

said backing panel is at least partially transmissive to illumination; and further comprising means operative to illuminate the message strips disposed in said channels defined between the masks and the backing panels.

13. Apparatus as in claim 12, wherein:

said plural masks are contiguously affixed to the front side of said backing panel; and said masks each having longitudinal sides which mutually overlap the adjoining longitudinal sides of the contiguous masks, so as to prevent illumination from being visible from the front of the masks except through said window means.

* * * * *